United States Patent [19]

Lulich

[11] Patent Number: 4,757,293

[45] Date of Patent: Jul. 12, 1988

[54] SOLENOID FOR DIRECT MOUNTING ON ENGINES

[75] Inventor: John F. Lulich, Pittsburgh, Pa.

[73] Assignee: R.P.M. Industries, Inc., Washington, Pa.

[21] Appl. No.: 55,448

[22] Filed: May 29, 1987

[51] Int. Cl.[4] ..... H01H 51/30

[52] U.S. Cl. ..... 335/104; 335/193; 335/247; 335/277

[58] Field of Search ..... 335/104, 105, 191, 192, 335/193, 257, 247, 248, 277, 126

[56] References Cited

U.S. PATENT DOCUMENTS

| | | | |
|---|---|---|---|
| 2,417,438 | 3/1947 | O'Brien et al. | 335/257 |
| 2,735,047 | 2/1956 | Garner et al. | 335/257 |
| 3,134,932 | 5/1964 | Ray | 335/257 |

*Primary Examiner*—E. A. Goldberg
*Assistant Examiner*—Lincoln Donovan
*Attorney, Agent, or Firm*—Reed Smith Shaw & McClay

[57] ABSTRACT

A solenoid is fitted with three dampers, two located on opposite sides of a flange in the solenoid and the third within the cell bore. The dampers allow movement of a plunger that supplies mechanical energy from electrical energy passed through the solenoid. The dampers absorb vibrational energy that would otherwise break apart the solenoid.

5 Claims, 2 Drawing Sheets

SOLENOID FOR DIRECT MOUNTING ON ENGINES

FIELD OF THE INVENTION

The present invention relates to solenoids. More specifically, the present invention relates to solenoids that are used in a high vibration environment.

BACKGROUND OF THE INVENTION

Solenoids convert electrical energy into mechanical energy. Their basic operation is well known in the art and involves the passing of electrical current through a coil winding. A mechanical system that communicates with the coil winding is operated upon by the force produced by the electricity passing through the coil. Typically, the coil is cylindrical with a hollow interior into which a portion of the mechanical system that the coil operates upon is fitted.

In stable secure environments essentially the only concern in the design of a solenoid is ensuring enough force is produced by the coil to cause the mechanical system to operate as required. However, in many high vibration environments, such as on internal combustion engines, unless extreme measures are taken in the design of the solenoid, the solenoid commonly breaks apart after a short period of time. Currently, no simple inexpensive way exists to allow solenoids to withstand high vibration environments.

SUMMARY OF THE INVENTION

Accordingly, one object of the present invention is to provide a solenoid that can survive in high vibration environments over long periods of time.

Another object of the present invention is to provide a simple inexpensive way to dampen the vibration in a solenoid without affecting the solenoid's performance.

These and other objects of the present invention are achieved with an apparatus for converting electrical energy into mechanical energy in high vibration environments comprising the following elements:

- A coil winding through which electricity travels. The coil has a surface.
- A housing having a hollow center, said coil is situated in the housing and positioned about the hollow center. The housing has a cap, with a hole or indentation in the center, placed over its top.
- A first set of electrical contacts comprised of a first electrical contact and a second electrical contact located on and through the housing. The first set of electrical contacts create a current path through which electricity enters the coil and leaves the coil, respectively. The contacts are electrically connected to the coil.
- At least a second set of electrical contacts comprised of a third electrical contact and a fourth electrical contact located on and through the housing. The second set of electrical contacts create a current path through which electricity passes when the second set of electrical contacts are connected.
- A mechanical plunger with a flange. The plunger has a first end with a top located on a first side of said flange. The plunger also has a second metal end located on a second side of the flange. The first end top is positioned in front of the opening in the cap, with the opening in the cap having sufficient clearance to avoid any contact with the first end top. The second end is disposed in the hollow center of the winding. The flange contacts the second positive and second negative electrical contacts when a current passes through the coil winding. The flange is small enough so it does not contact the housing.
- Means for causing the plunger to return to its original position in the housing after a force has been applied to it from the coil having a current pass therethrough.
- A first vibration damper is located between the cap and the first side of the flange and may be part of the cap as in injection molded parts. The first damper has an opening or indentation at least as large as the opening in the cap and the first damper is located around the first end.
- A second vibration damper is located around the second end. It is flush against the second side of the flange.
- A third vibration damper located on and circumferentially lining the hollow center of the housing. The third damper surrounds the second metal end. The third damper prevents the second end from hitting the coil winding when vibration is present.
- The dampers absorb most of the vibration experienced in the housing so the housing with the winding and plunger assembly are not shaken apart.

BRIEF DESCRIPTION OF THE DRAWINGS

A more complete appreciation of the invention and many of the tentative advantages thereof are readily obtained as the same becomes better understood by reference to the following detailed description when considered in connection with the accompanying drawings, wherein.

DESCRIPTION OF THE PREFERRED EMBODIMENT

Figure 1:
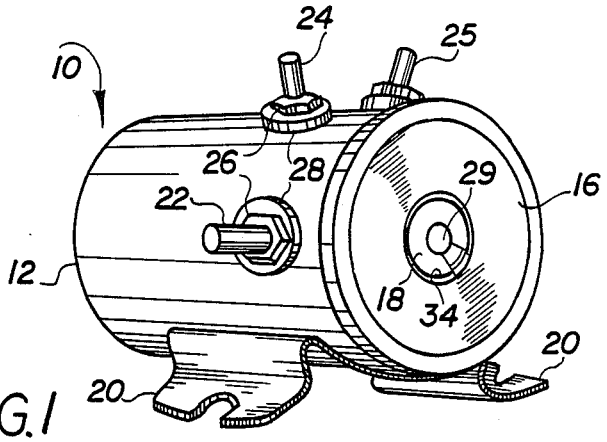
FIG. 1 is an angular side view of the solenoid.
Figure 2:
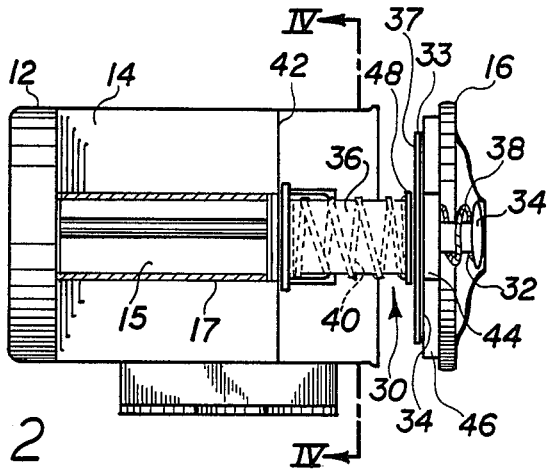
FIG. 2 is a cross sectional side view of the solenoid.
Figure 3:
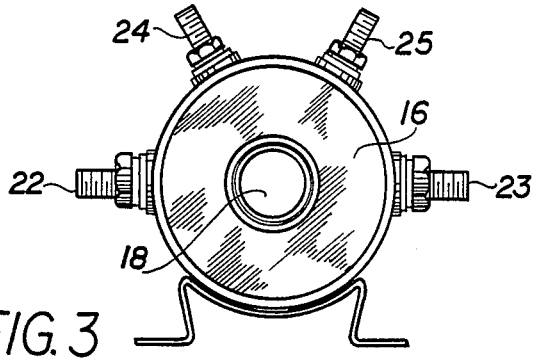
FIG. 3 is an end view of the solenoid.

Referring now to the drawings, wherein like reference numerals designate identical or corresponding parts thereto, and more particularly to FIG. 1 thereof, numeral 10 designates a solenoid. The solenoid 10 is comprised of a housing 12 within which coil winding 14 is situated. (See FIG. 2.) The housing 12 has a cap 16, (FIG. 3), with a hole or recess 18 through the center of the cap 16. The hole 18 has excess clearance to prevent a first end 32 with a top 29 and a closure 34 (as discussed more fully below) from contacting the cap 16. Instead of a hole 18 there can be an indentation 19 that meets the same requirements as the hole. The housing 12 has two supports 20 which affixedly attach the solenoid 10 to a desired base such as an engine via screws or bolts (not shown).

The solenoid 10 has a first set of electrical contacts comprised of a first electrical contact 22 and a second electrical contact 23 located on and through the housing 12 for creating a circuit through which electric current is passed when electricity enters the coil 14 through at least a second set of electrical contacts comprised of a third contact 25 and a fourth contact 24. The electricity enters the coil 14 through contact 25 and leaves the coil 14 through contact 24. The contacts 24 and 25 are connected to the coil winding 14 by way of a single wire soldered to each contact. Contact 22 and contact 23 each have bolts 26 that, when tightened hold supply and ground wires (not shown) to the base 28 of the contacts wherein an electrical connection is made.

The mechanical plunger 30 has a first end 32 with a top 29 located on a first side 54 of the flange 33 and a second metal end 36 located on a second side 37 of said flange 33. The top 29 of the first end 32 is positioned in front of the opening 18 of the cap 16, and the second end 36 is disposed in the hollow center 15 of the winding 14 when the solenoid 10 is assembled. A closure 34 is situated around the top 29 of the first end 32. Closure 34 must not be able to contact cap 16. If closure 34 is able to contact cap 16, a short circuit may occur or vibration may cause the closure 34 and cap 16 to strike each other or rub one another under high frequency vibration as to cause closure 34 to wear thin and eventually break apart, thereby damaging or rendering inoperable the solenoid 10.

A first biasing means 38, such as a spring, is situated around the first end 32 of the plunger 30. The bottom of the spring 38 rests flush against the first side 54 of the flange 33, and the top of the spring 38 rests flush against the closure 34. A second biasing means 40 is situated around the second end 36 of the plunger 33.

Figure 4:
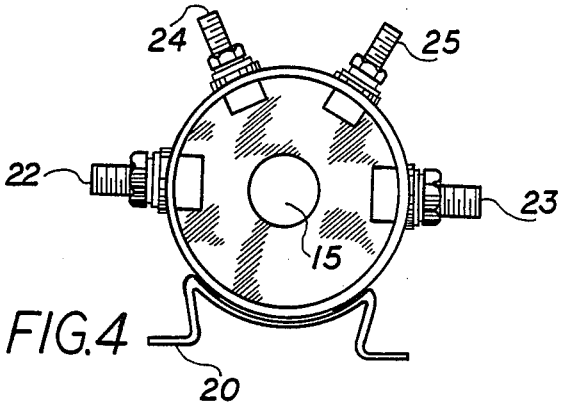
FIG. 4 is a sectional elevation of the interior taken along line IV—IV of FIG. 3.

In the operation of the plunger, the flange 33 which is fixedly attached and surrounding the plunger rests against the side 42 of the coil 14 or at some position below the internal portions of contacts 22, 23 and apart from them in the unactuated state. If a compressive force is applied to the plunger 30 at either the first end 32 or the second end 36 the plunger slides with the flange 33. As the first end 32 slides through the plunger upon compression, the spring 38 is depressed causing potential energy to build therein. When the force pulling the plunger 30 through the flange 33 is removed, the potential energy in the spring 38 causes the plunger to return to its original position. Here, the compressive force comes from a magnetic field pulling down on the second end 36 of the plunger 30. The magnetic field is produced by electrical current flowing through the coil 14. When a compressive force is applied the metal flange 33 contacts the internal portions of contacts 22 and 23 (see FIG. 4), essentially closing a switch, thus allowing current to pass from contact 23 through flange 33 and out contact 22. When the compressive force is released, the switch opens, and no current flows. Thus, current flow through the switch is controlled by the current passing through the contacts 24 and 25 connected to the coil 14.

A ring 44 located on the first side 54 of the flange 33 surrounds the bottom of the spring 38 and prevents it from moving out of position. Spring 40, which is housed above/inside the hollow center 15 of the winding 14 and surrounds the second end 36 of the plunger 30, provides a force against the second side 38 of the flange. The force causes the plunger through the flange 33 to abut the cap 16 (but not touch) and ensures that the top 29 of the first end 32 extends out as far as possible to the opening 18.

In order to allow the solenoid to operate over a long period of time in a high vibration environment, a first vibration damper 46, such as a rubber washer, is located between the cap 16 and the first side 54 of the flange 33. The first vibration damper 46 may be part of the cap, such as a plastic molding, etc. The first vibration damper has an opening at least as large as the opening 18 in the cap 16 to allow the first end 32 of the plunger 30 to slide easily therethrough. The flange 33 serves a dual role as a circuit link and as a stop for the plunger. This is important so the first end 32 and the closure do not act as the stop and contact the cap 16. A second vibration damper 48, for instance a wooden or fiber washer, is located around the second end 36 of the plunger 30 and is flush against the second side 38 of the flange 33. The second damper 48 is also located between the top of the spring 40 and the flange 33. The second damper 48 is usually of a harder or stiffer vibration absorbing material to more effectively pass the force of the second biasing means onto the flange. The use of two dampers 46, 48 on each side of flange 33 allows vibrations to be absorbed effectively on either side of the flange.

A stainless steel or other non-magnetic shim 17 lines the hollow center 15 of the winding 14. The inside diameter of the shim 17 is large enough that the second metal end fits through the shim 17. The shim 17, a third vibration damper, absorbs the vibration in the second end 36. It prevents the second end 36 from hitting the coil 14 and breaking it apart.

The first and second dampers 46, 48 on either side of the flange 33, are snugly fitted in place. This is accomplished by the spring 40 pressing against the second damper 48, which in turn is pressing against the flange 33. The flange 33 is, in turn, pressing against the first damper 46, causing the first damper to be snugly fitted against the cap 16. When vibration is experienced by the solenoid 10, the first and second dampers absorb most of the vibrational energy by damping the vibrating, thus preventing the solenoid 10 from breaking up over time. What is key to preventing any breakup of the solenoid 10 is preventing the components of the solenoid from striking each other. Specifically, the flange 33 should not hit the housing 12; the closure 34 holding the spring 40 should not hit the cap 16; and the second end 36 should not hit the inside of coil 14. This is especially true for the high frequency vibrations which have a wavelength small compared to the solenoid size. These high frequency vibrations, such as 20 hertz or more, are the most destructive because the solenoid is jostled back and forth very abruptly and quickly, causing extreme stress between the components and the housing of the solenoid. Of course, the high frequency vibrations are the most common since the vibration is coming from the underlying support device, such as an engine. The engine, because of its size and because it is fixed in place, is limited to small movements during operation. These movements are translated to the solenoid as vibrations. Lower frequency vibrations usually have associated with them greater movement of the underlying device upon which the solenoid is placed. The lower frequency vibrations tend to move the entire solenoid with its components in a common way, so stresses are not built up that are as severe as the situation with high frequency vibrations present. In the high frequency vibrations situation, the momentum of the components, created from a vibration, causes them to move in one direction while a next vibration causes the housing 12 to move in an opposite direction, with the components lagging behind in their response to the next vibration. This is true because the housing 12 is fixed to the vibration source, for instance an engine, while the components are situated in the housing 12. The energy from the vibration takes time to pass through the housing 12 to the components therein. This divergence of direction continues until the momentum of the components in the housing 12 changes, due to the next vibration, and the component's momentum is in the same direction that the housing 12 is moving in. However, the vibrations are coming so fast, the housing and components therein never have an opportunity to move effectively in the same direction before the next vibration arrives. Note, the movement being described here is extremely small. There is no macroscopic sliding of the components in the housing 12. But, the fact there are forces built up between the components and the housing is what is detrimental to the life of the solenoid 10.

The above described embodiment utilizes a compressive force from the coil 14 to pull the plunger 30 down into the housing 10. By, for instance, changing the current direction in the coil 14, removing the spring 38 and placing it on the opposite side of the closure 34 so it is between the top 34 and the cap 16, the plunger 30 can be operated in an exposure mode. In an exposure mode, the plunger 30 pushes up towards the opening 18 of the cap upon application of a force rather than down from the cap 16 as described above.

Obviously, numerous (additional), modifications and variations of the present invention are possible in light of the above teachings. It is therefor to be understood that within the scope of the impending claim the invention may be practiced otherwise than it is specifically described herein.

What is claimed is:

1. An apparatus for converting electrical energy into mechanical energy by a high vibration environment comprising:

a coil winding through which electricity travels, said winding have a surface;

a housing having a hollow center, said coil winding is situated on the housing and positioned about the hollow center; said housing having a cap with a hole in the center;

a first set of electrical contacts comprised of a first electrical contact and a second electrical contact located on and through said housing for creating a current path through which electricity enters the coil winding;

at least a second set of electrical contacts comprised of a third electrical contact and a fourth electrical contact located on and through said housing for creating a current path through which electricity passed when the second set of electrical contacts are connected;

a mechanical plunger with a flange, said plunger having a first end with a top located on a first side of said flange and a second metal end located on a second side of said flange, said first end top positioned in front of the opening in the cap with the opening in the cap having sufficient clearance to avoid any contact with the first end top, said second end disposed in the hollow center of the winding, said flange contacting the second positive and second negative electrical contacts when a current passes through the coil winding, said flange being small enough so it does not contact the housing;

means for causing said plunger to return to its original position in said housing after a force has been applied to it from the coil winding having a current passing therethrough;

a first vibration damper located between the cap and the first side of said flange, said first damper having an opening at least as large as the opening in the cap, said first damper located around said first end;

a second vibration damper located around said second end and flush against the second side of said flange; and a third vibration damper which is non-magnetic and located on and circumferentially lining the hollow center of the housing, said third damper surrounding the second metal end, said third damper preventing said second end from hitting said coil winding when vibration is present, wherein said dampers absorb most of the vibration experienced by the housing so the housing with the winding and plunger are not shaken apart.

2. An apparatus for converting electrical energy into mechanical energy by a high vibration environment comprising:

a coil winding through which electricity travels, said winding have a surface;

a housing having a hollow center, said coil winding is situated in the housing and positioned about the hollow center; said housing having a cap with a hole in the center;

a first set of electrical contacts comprised of a first electrical contact and a second electrical contact located on and through said housing for creating a current path through which electricity enters the coil winding;

at least a second set of electrical contacts comprised of a third electrical contact and a fourth electrical contact located on and through said housing for creating a current path through which electricity passes when the second set of electrical contacts are connected;

a mechanical plunger with a flange, said plunger having a first end with a top located on a first side of said flange and a second metal end located on a second side of said flange, said first end top positioned in front of the opening in the cap with the opening in the cap having sufficient clearance to avoid any contact with the first end top, said second end disposed in the hollow center of the winding, said flange contacting the second positive and second negative electrical contacts when a current passed through the coil winding, said flange being small enough so it does not contact the housing;

a closure situated around the top of the first end;

a first biasing means with a top and a bottom situated around said first end with the bottom flush against said flange's first side and the top flush against said closure;

a second biasing means with a top situated around said second end;

a first vibration damper located between the cap and the first side of said flange, said first damper having an opening at least as large as the opening in the cap, said first damper located around said first end with said first biasing means situated therebetween;

a second vibration damper located around said second end, flush against the second side of said flange, and between the top of the second biasing means and said flange wherein the second biasing means forces the first side of said flange up against said first damper, and the first biasing means forces said closure surrounding the top of said first end up towards the opening in the cap, with the plunger being pulled away from the opening in the cap when electricity passes through the winding; and a third vibration damper which is non-magnetic and located on and circumferentially lining the hollow center of the housing, said third damper surrounding the second metal end, said third damper preventing said second end from hitting said coil winding when vibration is present, wherein said dampers absorb most of the vibration experienced by the housing so the housing with the winding and plunger are not shaken apart.

3. An apparatus as described as claimed in claim 2, wherein the first biasing means and the second biasing means are springs, and the first vibration damper and the second vibration damper are washers made of vibration absorbing material.

4. In a solenoid having a hollow coil winding with a side; a plunger with a flange therearound, said plunger having a first end on a first side of the flange and a second metal end on a second side of the flange, the second end of the plunger being situated in the hollow coil winding so a force from the coil winding moves the plunger, the plunger and coil winding being located in a housing with a cap having a hole in the center, the improvement comprising:

first damping means surrounding the first end of the plunger and being snugly positioned between the cap and the first side of the flange to prevent the first end of the plunger from contacting the cap, said hole in said cap also allowing the first end of the plunger sufficient clearance to avoid any contact with the first end;

second damping means surrounding the second end of the plunger and being snugly positioned between the side of the coil and the second end of the flange; and a third vibration damper means which is nonmagnetic and located on and circumferentially lining the hollow center of the housing, said third damper surrounding the second metal end, said third damper preventing said second end from hitting said coil winding when vibration is present, wherein said dampers absorb most of the vibration experienced by the housing so the housing with the winding and plunger are not shaken apart.

5. An apparatus for converting electrical energy into mechanical energy by a high vibration environment comprising:

a coil winding through which electricity travels, said winding have a surface;

a housing having a hollow center, said coil winding is situated in the housing and positioned about the hollow center; said housing having a cap with an indentation in the center;

a first set of electrical contacts comprised of a first electrical contact and a second electrical contact located on and through said housing for creating a current path through which electricity enters the coil winding;

at least a second set of electrical contacts comprised of a third electrical contact and a fourth electrical contact located on and through said housing for creating a current path through which electricity passes when the second set of electrical contacts are connected;

a mechanical plunger with a flange, said plunger having a first end with a top located on a first side of said flange and a second metal end located on a second side of said flange, said first end top positioned in front of the indentation in the cap with the indentation in the cap having sufficient clearance to avoid any contact with the first end top, said second end disposed in the hollow center of the winding, said flange contacting the second positive and second negative electrical contacts when a current passes through the coil winding, said flange being small enough so it does not contact the housing;

means for causing said plunger to return to its original position in said housing after a force has been applied to it from the coil winding having a current passing therethrough;

a first vibration damper located between the cap and the first side of said flange, said first damper having an opening large enough to allow the first end to pass through, said first damper located around said first end;

a second vibration damper located around said second end and flush against the second side of said flange; and a third vibration damper which is non-magnetic and located on and circumferentially lining the hollow center of the housing, said third damper surrounding the second metal end, said third damper preventing said second end from hitting said coil winding when vibration is present, wherein said dampers absorb most of the vibration experienced by the housing so the housing with the winding and plunger are not shaken apart.

* * * * *